US010480172B2

(12) United States Patent
Ohde

(10) Patent No.: US 10,480,172 B2
(45) Date of Patent: Nov. 19, 2019

(54) BUILDING STRUCTURE, BUILDING, AND BUILDING CONSTRUCTION METHOD

(71) Applicant: KABUSHIKI KAISYA SBL, Oyama-shi, Tochigi (JP)

(72) Inventor: Masataka Ohde, Oyama (JP)

(73) Assignee: KABUSHIKI KAISYA SBL, Oyama-shi, Tochigi (JP)

( * ) Notice: Subject to any disclaimer, the term of this patent is extended or adjusted under 35 U.S.C. 154(b) by 0 days.

(21) Appl. No.: 15/739,720

(22) PCT Filed: Aug. 18, 2016

(86) PCT No.: PCT/JP2016/074067
§ 371 (c)(1),
(2) Date: Dec. 23, 2017

(87) PCT Pub. No.: WO2017/030159
PCT Pub. Date: Feb. 23, 2017

(65) Prior Publication Data

US 2018/0187406 A1 Jul. 5, 2018

(30) Foreign Application Priority Data

Aug. 19, 2015 (JP) ..... 2015-161641

(51) Int. Cl.
*E04B 1/19* (2006.01)
*E04B 1/24* (2006.01)
(Continued)

(52) U.S. Cl.
CPC ..... *E04B 1/19* (2013.01); *E04B 1/2403* (2013.01); *E04C 3/04* (2013.01); *E04B 1/342* (2013.01);
(Continued)

(58) Field of Classification Search
CPC ..... E04B 1/19; E04B 1/342; E04B 1/2403; E04B 2001/2457; E04B 2001/2487;
(Continued)

(56) References Cited

U.S. PATENT DOCUMENTS 354,558 A * 12/1886 Latimer ..... E01B 25/305 104/124
607,335 A * 7/1898 Boring ..... E04C 3/17 52/639
(Continued)

FOREIGN PATENT DOCUMENTS

JP 46009023 * 3/1971
JP 2001262687 A 9/2001
(Continued)

*Primary Examiner* — Adriana Figueroa
(74) *Attorney, Agent, or Firm* — Patshegen IP LLC; Moshe Pinchas

(57) ABSTRACT

Provided is a building structure enabling use of a horizontal member made of heavy gauge steel and braces installed between pillars erected in a longitudinal direction to be eliminated and structurally efficient.

A building structure of the present invention includes: a horizontal member (10) installed between pillars (30) erected in a longitudinal direction; and a unit (20) installed on the horizontal member (10), wherein the horizontal member (10) is made of light gauge steel, the unit (20) includes: 1) a horizontal frame (21) including a short side member (21*a*) and formed in a rectangular shape; 2) a beam (22) connected to a center of the short side member (21*a*) in a lengthwise direction to be perpendicular to the horizontal frame (21) and having a truss structure; 3) a first diagonal member (23) installed between one end of the short side member (21*a*) and the beam (22); and 4) a second diagonal member (24) installed between another end of the short side member (21*a*) and the beam (22), the short side member (21*a*) is an upper chord member of a girder (50) connected
(Continued)

to the pillar (30) and having a truss structure, the horizontal member (10) is a lower chord member of the girder (50), a vertical member (22*c*) of the beam (22) is a vertical member of the girder (50), and the first diagonal member (23) and the second diagonal member (24) are diagonal members of the girder (50).

5 Claims, 7 Drawing Sheets

(51) Int. Cl.
*E04C 3/04* (2006.01)
*E04B 1/342* (2006.01)

(52) U.S. Cl.
CPC ..... *E04B 2001/2457* (2013.01); *E04C 2003/0473* (2013.01); *E04C 2003/0486* (2013.01)

(58) Field of Classification Search
CPC ..... E04B 2001/2472; E04C 3/04; E04C 2003/0473; E04C 2003/0486
See application file for complete search history.

(56) References Cited

U.S. PATENT DOCUMENTS 2,284,898 A * 6/1942 Hartman ..... E04B 1/19 52/376
3,111,207 A * 11/1963 Braddon ..... E04C 3/09 138/156
3,768,216 A * 10/1973 Shirota ..... E04B 1/19 52/650.1
3,872,532 A * 3/1975 Cornelius ..... E01D 2/04 14/3
3,893,276 A * 7/1975 Brown ..... E04B 9/00 52/475.1
3,927,499 A * 12/1975 Papayoti ..... E04B 1/19 52/263
4,211,044 A * 7/1980 Gugliotta ..... E04B 1/19 52/200
4,282,619 A * 8/1981 Rooney ..... E01D 2/04 14/6
4,349,996 A * 9/1982 Lautensleger ..... E04B 7/00 403/230
4,569,177 A * 2/1986 Ottinger ..... E04B 1/19 52/654.1
5,203,428 A * 4/1993 Beeche ..... E04B 1/19 182/113
7,578,109 B2 * 8/2009 Reynolds ..... E04B 1/19 52/648.1
8,887,470 B2 * 11/2014 Werner ..... F24J 2/14 52/648.1
9,422,680 B2 * 8/2016 Furlanetto ..... E01D 6/00
9,803,364 B2 * 10/2017 Hsieh ..... E04C 3/08

FOREIGN PATENT DOCUMENTS

JP 2003074116 A * 3/2003
JP 2007-026560 * 8/2005

* cited by examiner

BUILDING STRUCTURE, BUILDING, AND BUILDING CONSTRUCTION METHOD

TECHNICAL FIELD

The present invention relates to a building structure, a building having the building structure, and a building construction method.

BACKGROUND ART

Conventionally known is a building structure including a unit installed on a horizontal member. For example, Patent Literature 1 described below discloses such a building structure and has the following problem.

A building structure described in Patent Literature 1 (hereinbelow referred to as "a conventional technique") has a configuration in which a unitary-structured wall girder connecting upper ends of pillars erected in a longitudinal direction is used as a horizontal member, and in which a unit is installed on this wall girder, and the wall girder is thus required to have high bending strength. For this reason, in such a building structure, heavy gauge steel such as H-shaped steel and I-shaped steel is used as the horizontal member. However, since this horizontal member is heavy, it is not easy to install the horizontal member on the pillars. Also, using the heavy gauge steel causes not only a problem of increasing the weight of the building but also a problem of increasing the material cost.

In the conventional technique, since the unitary-structured wall girder is connected to the pillars by means of pin joint, braces are required between the pillars erected in the longitudinal direction. On the other hand, in a case in which a glass wall is used as a wall material to be installed in the longitudinal direction, there is a demand for eliminating the braces. However, in the building structure requiring the braces, such a demand cannot be met.

In the conventional technique, the unit includes 1) a rectangular horizontal frame including a short side member, 2) a truss-structured beam connected to a center of the short side member in a lengthwise direction to be perpendicular to the horizontal frame, 3) a first diagonal member installed between one end of the short side member and the beam, and 4) a second diagonal member installed between the other end of the short side member and the beam. However, since this unit is installed on the horizontal member (wall girder) in a state in which the horizontal frame and the beam stand upright in an inverted T shape, the horizontal frame and the horizontal member overlap with each other, which is structurally inefficient.

CITATION LIST

Patent Literature

Patent Literature 1: JP 4857272 B2

SUMMARY OF INVENTION

Technical Problem

To solve the problem, the present invention provides a building structure, a building, and a building construction method enabling use of a horizontal member made of heavy gauge steel and braces installed between pillars erected in a longitudinal direction to be eliminated and structurally efficient.

Solution to Problem

To solve the above problem, the present invention provides a building structure including: a horizontal member installed between pillars erected in a longitudinal direction; and a unit installed on the horizontal member, wherein the horizontal member is made of light gauge steel, the unit includes: 1) a horizontal frame including a short side member and formed in a rectangular shape; 2) a beam connected to a center of the short side member in a lengthwise direction to be perpendicular to the horizontal frame and having a truss structure; 3) a first diagonal member installed between one end of the short side member and the beam; and 4) a second diagonal member installed between another end of the short side member and the beam, the short side member is an upper chord member of a girder connected to the pillar and having a truss structure, the horizontal member is a lower chord member of the girder, a vertical member of the beam is a vertical member of the girder, and the first diagonal member and the second diagonal member are diagonal members of the girder, and a building having the building structure. Also, the present invention provides a building construction method including: a process of assembling a unit, the unit including: 1) a horizontal frame including a short side member and formed in a rectangular shape; 2) a beam connected to a center of the short side member in a lengthwise direction to be perpendicular to the horizontal frame and having a truss structure; 3) a first diagonal member installed between one end of the short side member and the beam; and 4) a second diagonal member installed between another end of the short side member and the beam; a process of installing a horizontal member made of light gauge steel between pillars erected in a longitudinal direction; and a process of installing the unit on the horizontal member so as for the short side member to be an upper chord member of a girder connected to the pillar and having a truss structure, for the horizontal member to be a lower chord member of the girder, for a vertical member of the beam to be a vertical member of the girder, and for the first diagonal member and the second diagonal member to be diagonal members of the girder.

Advantageous Effects of Invention

In a building structure and a building according to the present invention, a horizontal member is a lower chord member of a girder connected to pillars erected in a longitudinal direction and having a truss structure, and the horizontal member itself is not thus required to have high bending strength. Thus, the horizontal member is made of light gauge steel. According to the present invention, use of a horizontal member made of heavy gauge steel can be eliminated. Also, in the building structure and the building according to the present invention, the girder having the truss structure, in which a short side member is an upper chord member, in which the horizontal member is the lower chord member, in which a vertical member of a beam is a vertical member, and in which a first diagonal member and a second diagonal member are diagonal members, is connected to the pillars erected in the longitudinal direction. Thus, the pillars and the girder are integrated to form a rigid frame. According to the present invention, braces to be installed between the pillars erected in the longitudinal direction can be eliminated. Further, in the building structure and the building according to the present invention, a horizontal frame and the horizontal member do not overlap with each other, and the truss-structured girder is formed by combination of the horizontal member and the unit. According to the present invention, it is possible to provide the building structure and the building that are structurally efficient. Also, with a building construction method according to the present invention, it is possible to provide the building exerting the above effect.

DESCRIPTION OF EMBODIMENTS

Hereinbelow, embodiments of the present invention will be described specifically with reference to the drawings, and a technical scope of the present invention is not limited to the following description.

First Embodiment

Figure 1:
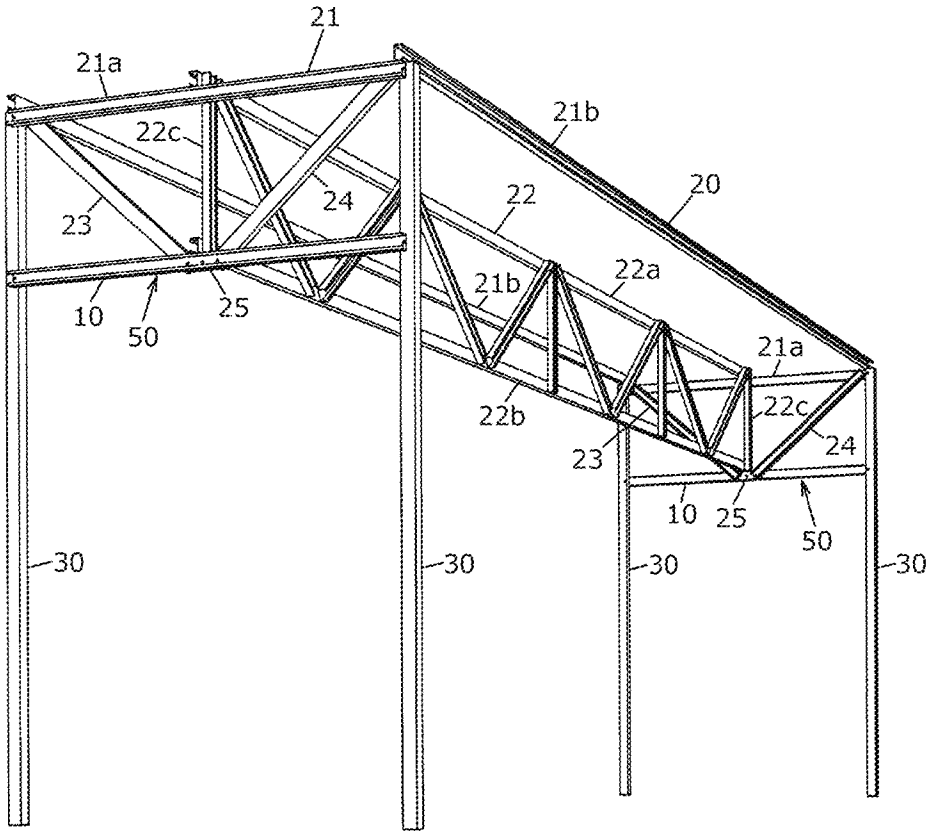
FIG. 1 illustrates a basic configuration of a building structure according to a first embodiment of the present invention.

As illustrated in FIG. 1, a building structure according to a first embodiment of the present invention includes a horizontal member 10 and a unit 20.

The horizontal member 10 is made of light gauge steel selected from a light gauge steel c-channel bar, a light gauge steel channel bar, and the like. Use of the light gauge steel is advantageous in terms of contribution to weight reduction of a building and a decrease in material cost. The horizontal member 10 is installed between pillars 30 erected in a longitudinal direction (refer to FIGS. 1, 6, and 7). Unlike the horizontal member (wall girder) used in the conventional technique, this horizontal member 10 is not connected to upper ends of the pillars 30. This horizontal member 10 is connected to the pillars 30 at lower positions than the upper ends of the pillars 30 (refer to FIGS. 1, 6, and 7).

As illustrated in FIGS. 1 to 4, the unit 20 includes a horizontal frame 21, a beam 22, a first diagonal member 23, and a second diagonal member 24.

Figure 2:
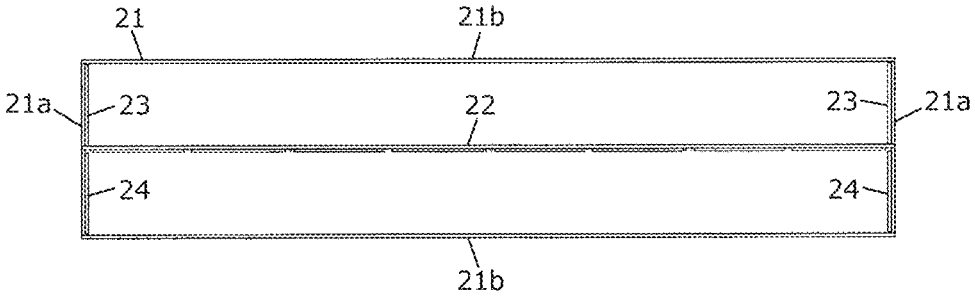
FIG. 2 is a plan view of a unit employed in the first embodiment of the present invention.

As illustrated in FIG. 2, the horizontal frame 21 is formed in a rectangular shape by a pair of short side members 21*a* and 21*a* and a pair of long side members 21*b* and 21*b*. The paired short side members 21*a* and 21*a* are arranged to be parallel to each other. The paired long side members 21*b* and 21*b* are arranged to be parallel to each other and are connected to the paired short side members 21*a* and 21*a* to be perpendicular to the paired short side members 21*a* and 21*a*.

Figure 5:
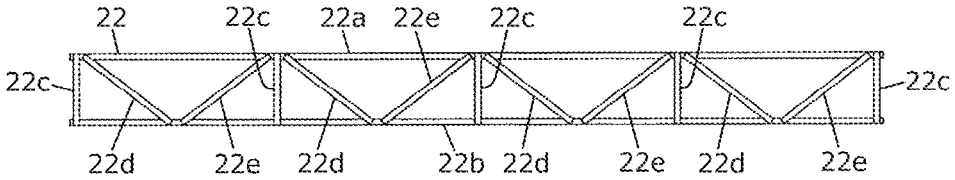
FIG. 5 is a side view of a beam constituting the unit employed in the first embodiment of the present invention.

The beam 22 is a beam that is not connected to the pillar 30. As illustrated in FIG. 5, the beam 22 is not in a unitary structure but in a truss structure. That is, the beam 22 includes an upper chord member 22*a*, a lower chord member 22*b* arranged to be parallel to the upper chord member 22*a*, a vertical member 22*c* arranged vertically between the upper chord member 22*a* and the lower chord member 22*b*, and diagonal members 22*d* and 22*e* arranged diagonally between the upper chord member 22*a* and the lower chord member 22*b*.

Figure 3:
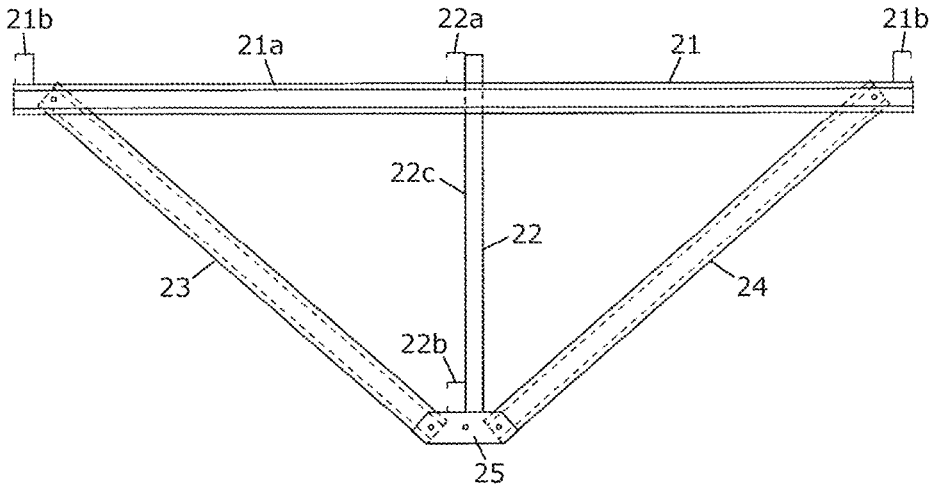
FIG. 3 is a front view of the unit employed in the first embodiment of the present invention.
Figure 4:
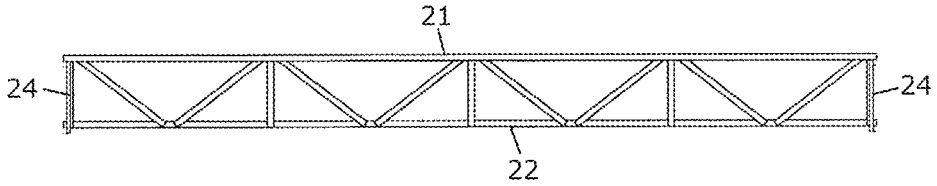
FIG. 4 is a side view of the unit employed in the first embodiment of the present invention.

As illustrated in FIGS. 2 and 3, the beam 22 is connected to a center of the short side member 21*a* in a lengthwise direction to be perpendicular to the horizontal frame 21. Thus, the horizontal frame 21 and the beam 22 stand upright in a T shape as illustrated in FIG. 3. The unit 20 employed in the present embodiment is different from the unit employed in the conventional technique, in which the horizontal frame and the beam stand upright in the inverted T shape, in that the horizontal frame 21 and the beam 22 stand upright in the T shape.

As illustrated in FIGS. 1 and 3, the first diagonal member 23 is installed between one end of the short side member 21*a* and the beam 22. In the unit 20 employed in the present embodiment, the first diagonal member 23 is connected to the beam 22 via a plate 25 provided around the lower chord member 22*b* of the beam 22.

As illustrated in FIGS. 1 and 3, the second diagonal member 24 is installed between the other end of the short side member 21*a* and the beam 22. In the unit 20 employed in the present embodiment, the second diagonal member 24 is connected to the beam 22 via the plate 25.

Materials for the short side member 21*a* and the long side member 21*b* constituting the horizontal frame 21, the upper chord member 22*a*, the lower chord member 22*b*, the vertical member 22*c*, and the diagonal members 22*d* and 22*e* constituting the beam 22, the first diagonal member 23, and the second diagonal member 24 are preferably light gauge steel whose cross-sections are in equal shapes and equal dimensions. Use of such materials facilitates design and manufacture and achieves cost reduction. Also, these members made of the light gauge steel can be connected mechanically with use of bolts and the like without the need for welding. Accordingly, lowering of assembly accuracy due to welding distortion does not occur, and high assembly accuracy can be achieved.

Figure 6:
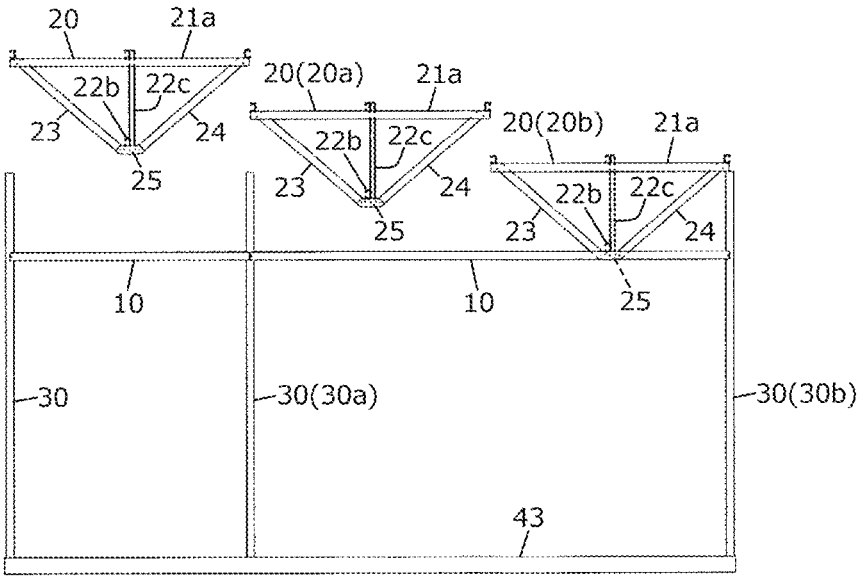
FIG. 6 illustrates a way to install the units.

In a typical building to which the present embodiment is applied, a plurality of units 20 are used. Also, as illustrated in FIG. 6, each unit 20 is preferably installed on the horizontal member 10 after the unit 20 is assembled in advance.

As illustrated in FIG. 1, the unit 20 is installed on the horizontal member 10 by connecting the short side member 21*a* of the horizontal frame 21 to the upper ends of the pillars 30 and connecting to the horizontal member 10 the plate 25 to which the beam 22, the first diagonal member 23, and the second diagonal member 24 are connected. In FIG. 1, both the ends of the short side member 21*a* are connected to the respective pillars 30, and the present invention is not limited to this. For example, as illustrated in FIGS. 6 and 7, in a case in which two units 20 (20*a*) and 20 (20*b*) are arranged between two pillars 30 (30*a*) and 30 (30*b*) erected in the longitudinal direction, one end of the short side member 21*a* of one unit 20 (20*a*) is connected to the pillar 30 (30*a*), the other end of the short side member 21*a* of the other unit 20 (20*b*) is connected to the pillar 30 (30*b*), and the other end of the short side member 21*a* of one unit 20 (20*a*) is connected to one end of the short side member 21*a* of the other unit 20 (20*b*).

Figure 7:
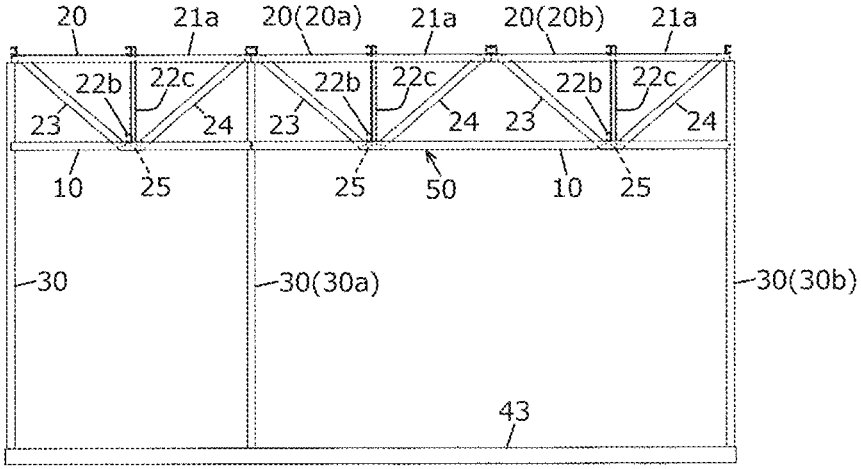
FIG. 7 illustrates a state in which the units are installed on a horizontal member.

As illustrated in FIGS. 1 and 7, the unit 20 is installed on the horizontal member 10 to cause a truss-structured girder 50 connected to the pillars 30 erected in the longitudinal direction to be formed. An upper chord member of this girder 50 is the short side member 21*a* constituting the horizontal frame 21, a lower chord member of the girder 50 is the horizontal member 10, a vertical member of the girder 50 is the vertical member 22*c* constituting the beam 22, and diagonal members of the girder 50 are the first diagonal member 23 and the second diagonal member 24.

In the present embodiment, since this girder 50 and the pillars 30 erected in the longitudinal direction are integrated to form a rigid frame, braces to be installed between the pillars 30 erected in the longitudinal direction can be eliminated (refer to FIG. 7).

Also, in the present embodiment, since the horizontal member 10 functions as a lower chord member of the girder 50, the horizontal member 10 itself is not required to have high bending strength. Accordingly, use of the horizontal member 10 made of heavy gauge steel can be eliminated.

Further, in the present embodiment, since the unit 20, in which the horizontal frame 21 and the beam 22 stand upright in the T shape, is installed on the horizontal member 10, the horizontal frame 21 and the horizontal member 10 do not overlap with each other (refer to FIGS. 1, 6, and 7). In addition, the truss-structured girder 50 is formed by combination of the horizontal member 10 and the unit 20 (refer to FIGS. 1 and 7). Accordingly, it is possible to provide a building structure and a building that are structurally efficient.

A method for constructing a building having the building structure according to the present embodiment includes the following processes:

(1) a process of assembling the unit 20 including 1) the horizontal frame 21 including the short side member 21*a* and formed in a rectangular shape, 2) a beam 22 connected to the center of the short side member 21*a* in the lengthwise direction to be perpendicular to the horizontal frame 21 and having a truss structure, 3) the first diagonal member 23 installed between one end of the short side member 21*a* and the beam 22, and 4) the second diagonal member 24 installed between another end of the short side member 21*a* and the beam 22, (2) a process of installing the horizontal member 10 made of light gauge steel between the pillars 30 erected in the longitudinal direction, and (3) a process of installing the unit 20 on the horizontal member 10 so as for the short side member 21*a* to be an upper chord member of the girder 50 connected to the pillar 30 and having a truss structure, for the horizontal member 10 to be a lower chord member of the girder 50, for the vertical member 22*c* of the beam 22 to be a vertical member of the girder 50, and for the first diagonal member 23 and the second diagonal member 24 to be diagonal members of the girder 50.

According to this construction method, since various kinds of members are unitized in process (1), a working efficiency at a construction site can drastically be improved. Also, since the horizontal member 10 is light in process (2), an installation work is easy. Further, since the unit 20 is installed on the horizontal member 10 to cause inclination of the pillars 30 to be corrected in process (3), a remarkable decrease of correction time can be achieved.

Second Embodiment

As illustrated in FIGS. 8 to 11, a building structure according to a second embodiment of the present invention differs from the building structure according to the first embodiment in that the beam 22 constituting the unit 20 includes projecting parts 22*f* and 22*g* projecting outward from the girder 50 having the truss structure.

Figure 12:
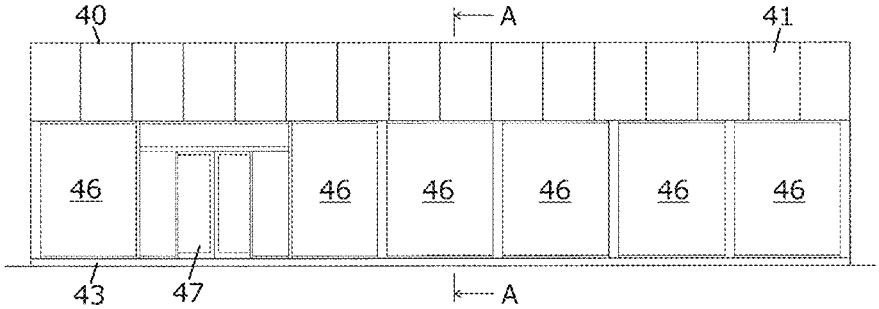
FIG. 12 is a front view of a building having the building structure according to the second embodiment of the present invention.
Figure 13:
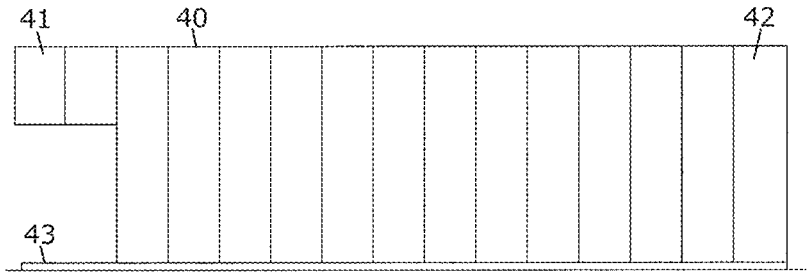
FIG. 13 is a side view of the building having the building structure according to the second embodiment of the present invention.
Figure 14:
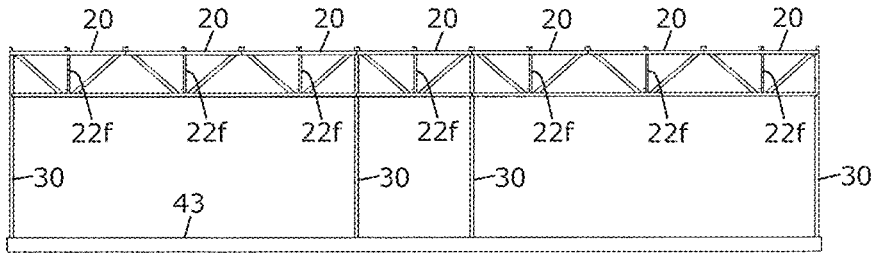
FIG. 14 is a front view illustrating a framework of the building having the building structure according to the second embodiment of the present invention.
Figure 15:
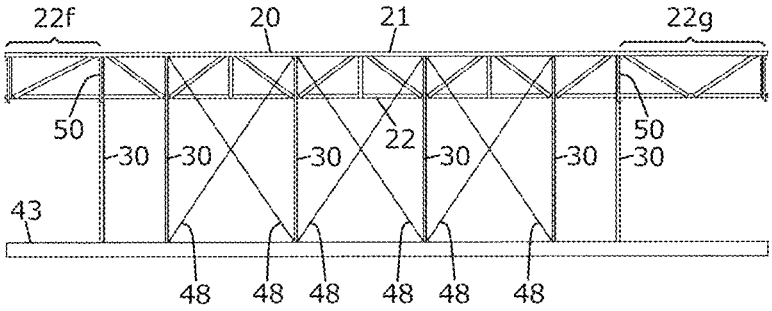
FIG. 15 is a side view illustrating the framework of the building having the building structure according to the second embodiment of the present invention.

FIG. 12 is a front view of a building 40 having a building structure according to the present embodiment, FIG. 13 is a side view thereof, FIG. 14 is a front view illustrating a framework thereof, and FIG. 15 is a side view illustrating the framework thereof. As illustrated in these figures, the projecting part 22*f* arranged on a front side of the building 40 constitutes a framework of an eave 41. On the other hand, the projecting part 22*g* arranged on a backside of the building 40 functions as an extension part of the beam 22.

Figure 11:
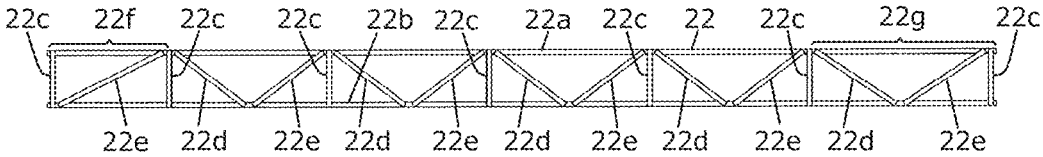
FIG. 11 is a side view of the beam constituting the unit employed in the second embodiment of the present invention.

As illustrated in FIG. 11, each of the projecting parts 22*f* and 22*g* is a part of the beam 22, not a part added to the beam 22. Thus, each of the projecting parts 22*f* and 22*g* is high in strength against a vertical load. Also, each of the projecting parts 22*f* and 22*g* is significantly lower in building cost than the part added to the beam 22.

Figure 8:
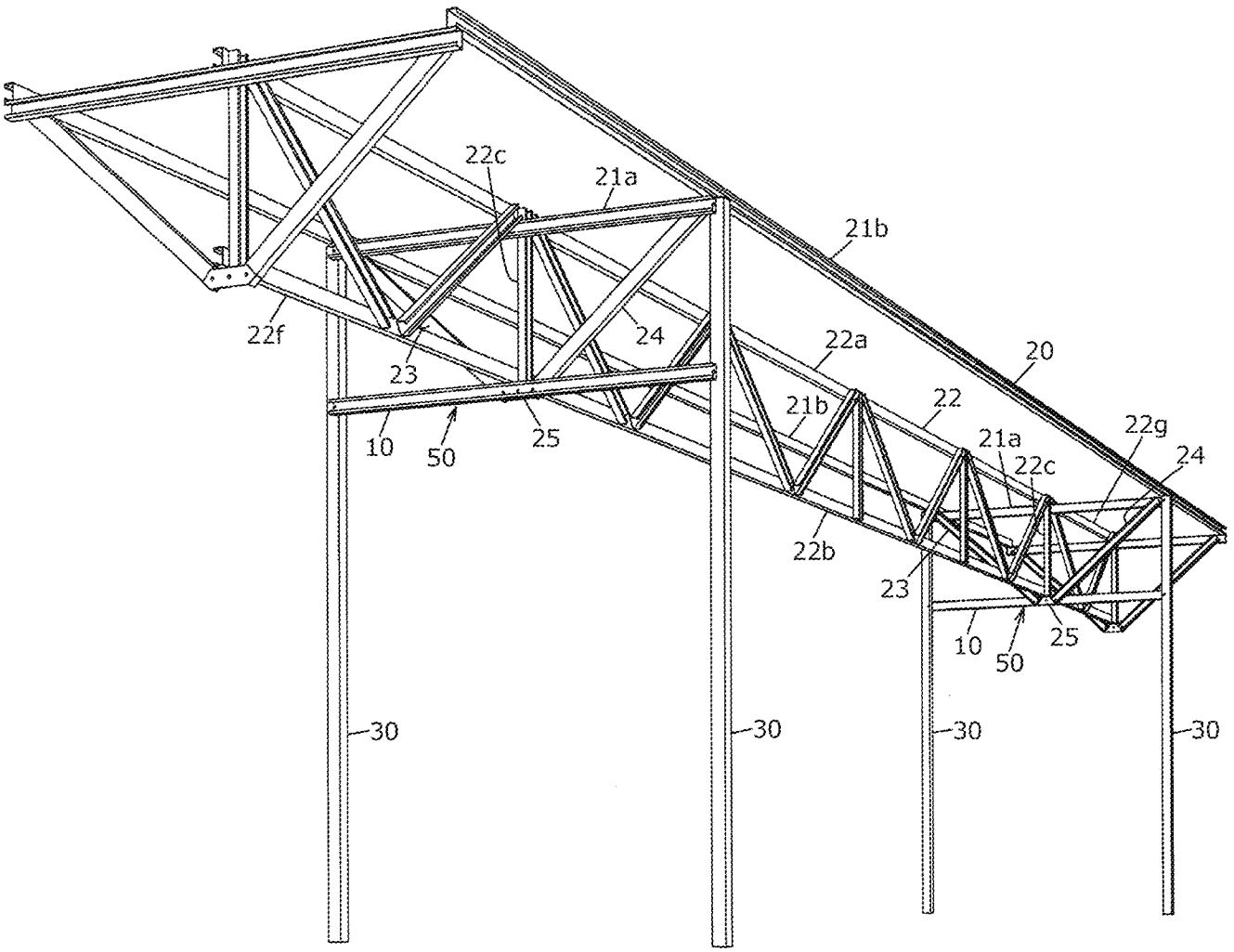
FIG. 8 illustrates a basic configuration of a building structure according to a second embodiment of the present invention.
Figure 9:
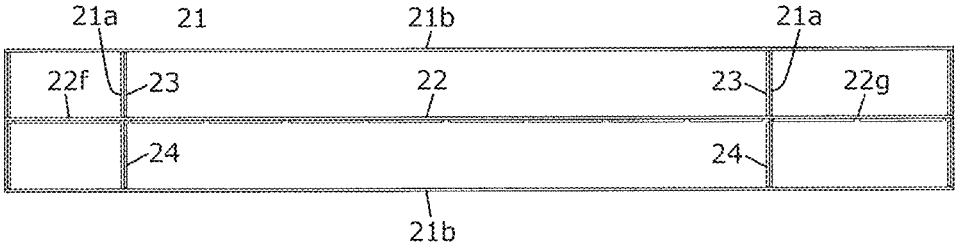
FIG. 9 is a plan view of the unit employed in the second embodiment of the present invention.
Figure 10:
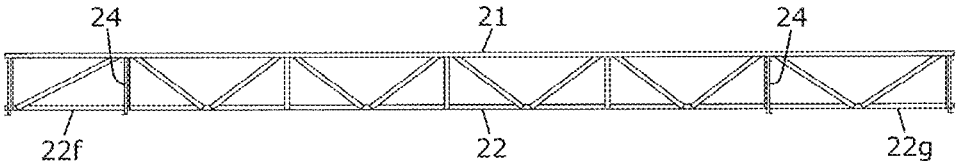
FIG. 10 is a side view of the unit employed in the second embodiment of the present invention.
Figure 16:
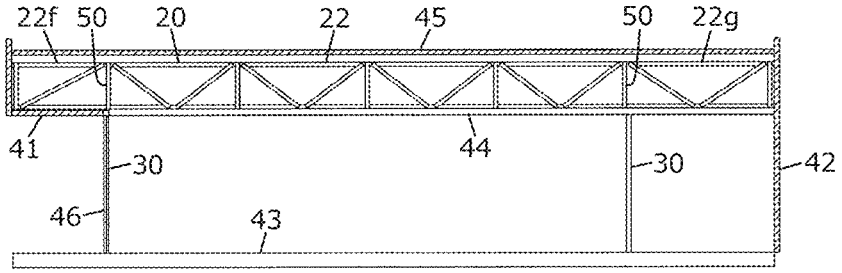
FIG. 16 is a cross-sectional view along the part A-A in FIG. 12.

As illustrated in FIGS. 8 and 15, a tip end of the projecting part 22*f* is a free end. Hence, no pillar supporting the edge of the eave of the building 40 is required. A tip end of the projecting part 22*g* is also a free end. Accordingly, as illustrated in FIG. 16, in a case in which a wall material 42 is installed at a tip end of the projecting part 22*g*, no pillar on a rear side in a room is required, and a floor area can be extended further than in a case in which a pillar exists on the rear side in the room.

In the building structure according to the present embodiment, similarly to the first embodiment, the unit 20 is installed on the horizontal member 10 to cause the truss-structured girder 50 connected to the pillars 30 erected in the longitudinal direction to be formed. Thus, braces to be installed between the pillars 30 erected in the longitudinal direction can be eliminated (refer to FIG. 14). Meanwhile, since no rigid frame is formed on the lateral side of the building 40, braces 48 are installed between the pillars 30 erected in a latitudinal direction (refer to FIG. 15).

The present invention can be applied to buildings in various uses such as a residential house, a retail store such as a convenience store, a restaurant, a factory, and a warehouse.

REFERENCE SIGNS LIST

10 horizontal member
20 unit
21 horizontal frame

21*a* short side member
21*b* long side member
22 beam
22*a* upper chord member
22*b* lower chord member
22*c* vertical member
22*d*, 22*e* diagonal member
22*f*, 22*g* projecting part
23 first diagonal member
24 second diagonal member
25 plate
30 pillar
40 building
41 eave
42 wall material
43 foundation
44 ceiling material
45 roof material
46 glass wall
47 doorway
48 brace
50 girder

The invention claimed is:

1. A building structure comprising:

a horizontal member installed between two pillars erected in a longitudinal direction; and a unit installed on the horizontal member, wherein the horizontal member is made of light gauge steel, the unit includes:

1) a horizontal frame including a short side member and formed in a rectangular shape;

2) a beam connected to a center of the short side member in a lengthwise direction to be perpendicular to the horizontal frame and having a truss structure;

3) a first diagonal member installed between one end of the short side member and the beam and is connected directly to the horizontal member; and 4) a second diagonal member installed between another end of the short side member and the beam and is connected to the horizontal member, the horizontal frame is arranged at the upper part of the beam, the short side member is an upper chord member of a girder connected directly to the two pillars and having a truss structure, wherein the truss structure is formed by the upper chord member which is connected to the two pillars, a lower chord member which is defined by the horizontal member and which is connected to the two pillars, a vertical member which is defined by a vertical member of the beam, and diagonal members defined by the first diagonal member and the second diagonal member such that a first triangle is formed by the horizontal member, one of the two pillars and the first diagonal member and a second triangle is formed by the horizontal member, one of the two pillars and the second diagonal member.

2. The building structure according to claim 1, wherein the beam includes a projecting part projecting outward from the girder, and a tip end of the projecting part is a free end.

3. A building having the building structure according to claim 1.

4. A building construction method comprising:

a process of installing a horizontal member made of light gauge steel between two pillars erected in a longitudinal direction;

a process of assembling a unit, the unit including:

1) a horizontal frame including a short side member and formed in a rectangular shape;

2) a beam connected to a center of the short side member in a lengthwise direction to be perpendicular to the horizontal frame and having a truss structure;

3) a first diagonal member installed between one end of the short side member and the beam; and 4) a second diagonal member installed between another end of the short side member and the beam; wherein the horizontal frame is arranged at the upper part of the beam, and a process of installing the unit on the horizontal member by connecting the first and second diagonal members directly to the horizontal member and by connecting the short side member directly to the two pillars such that the short side member defines an upper chord member of a girder connected to the two pillars and having a truss structure, wherein the truss structure is formed by the upper chord member, a lower chord member defined by the horizontal member, a vertical member which is defined by a vertical member of the beam, and diagonal members defined by, the first diagonal member and the second diagonal member such that a first triangle is formed by the horizontal member, one of the two pillars and the first diagonal member and a second triangle is formed by the horizontal member, one of the two pillars and the second diagonal member.

5. A building having the building structure according to claim 2.

* * * * *